US005115989A

United States Patent [19]

Poeschl

[11] Patent Number: 5,115,989

[45] Date of Patent: May 26, 1992

[54] DYNAMIC ROLLER MILL AIR CLASSIFIER

[75] Inventor: Franz Poeschl, Düsseldorf, Fed. Rep. of Germany

[73] Assignee: Loesche GmbH, Düsseldorf, Fed. Rep. of Germany

[21] Appl. No.: 656,549

[22] Filed: Feb. 19, 1991

[30] Foreign Application Priority Data

Feb. 19, 1990 [DE] Fed. Rep. of Germany ..... 4005031

[51] Int. Cl.[5] ..... B02C 23/32

[52] U.S. Cl. ..... 241/79.1; 241/119; 209/139.2

[58] Field of Search ..... 241/119, 121, 79.1; 209/139.2, 154

[56] References Cited

U.S. PATENT DOCUMENTS 857,988 6/1907 Fuller, Jr. ..... 209/154
1,623,040 4/1927 Baker et al. ..... 209/139.2
1,806,980 5/1931 Kreutzberg ..... 241/121
2,909,330 10/1959 Hardinge ..... 241/121
3,090,487 5/1963 Doyle ..... 209/139.2
3,306,443 2/1967 Sereno et al. ..... 209/154

FOREIGN PATENT DOCUMENTS 1557 9/1889 Switzerland .

*Primary Examiner*—Frank T. Yost
*Assistant Examiner*—John M. Husar
*Attorney, Agent, or Firm*—Fleit, Jacobson, Cohn, Price, Holman & Stern

[57] ABSTRACT

The invention relates to a dynamic roller mill air classifier, which is provided in integrated manner over a roller mill. As existing air classifiers suffered from certain disadvantages with respect to the specific energy requirement, the invention makes it possible to reduce the latter. The air classifier is designed as a downflow classifier, which classifies in an efficient manner with reduced flow rates.

9 Claims, 2 Drawing Sheets

DYNAMIC ROLLER MILL AIR CLASSIFIER

FIELD OF THE INVENTION

The invention relates to a dynamic roller mill air classifier with an integrated air classifier provided above a roller mill for a rising gas-ground material flow, with a classifier rotor having approximately vertical classifying ledges and flow-followed by at least one gas flow outlet and a fine material outlet, as well as at least one coarse material return.

DESCRIPTION OF THE PRIOR ART

Air classifiers of this type, which are directly integrated over a roller mill are generally known. A comparable air classifier is known from "Zement-Kalk-Gips", No. 10, 1987, p 524, FIG. 3.

In the flow principle provided therein, there is a rising gas-ground material flow in the outer area. In the upper area of the classifier it is fed radially and tangentially inwards via fixed guide blades to a centrifuge basket classifier. The gas-fine material flow is led off upwards in the centrifuge basket, whilst oversize material and tailings are returned downwards via a conical collector to the roller mill.

When milling and grinding raw material, e.g. in the cement industry and specifically in the case of clinker crushing, the problem of an energy-saving processing always arises, so that every effort is made to reduce the specific energy requirement of roller mills. In connection with classifying and pneumatic material conveying in roller mills, there are considered to be possibilities of making the process sequences more efficient, the function of the classifier being an essential criterion.

The problems and the associated disadvantages occurring with conventional integrated air classifiers or roller or ball mills, can be subdivided into roughly three larger groups.

The first consists of reducing the upwards energy of the ground material from the upper part of the mill and mainly fine material, with lower dynamic energy. It must be borne in mind in this connection that the gas-ground material flow or the material mass flow supplied to the classifier in a roller mill, is substantially dependent on the gas velocity in the vane ring around grinding pan, together with the gas flow direction and the gas velocity in the top part of the mill. Thus, frequently the gas-ground material flow to the classifier rising out of the mill chamber is confronted with part of the coarse material separated by the classifier and which flows downwards from the classifier casing and said countercurrent can in part reach 50%. Thus, part of the finished material present in the gas flow at the outlet from the top of the mill is returned together with the back-flowing coarse material to the grinding pan.

The actual classifier chamber with its ring clearance cross-section must be designed in such a way that the upwardly directed gas velocity also allows a downward movement of the particles deflected to the classifier wall. This can lead to a marked sensitivity of the classifier to gas quantity fluctuations and therefore to an influencing of the running of the roller mill. Thus, this disadvantageous effect can be referred to as the "bypass component", in which fine material particles which have been deflected outwards against to classifier wall in material streams, no longer have a possibility of being supplied to the actual classifier zone, i.e. in the vicinity of the classifying ledges.

This so-called bypass component probably influences in a roller mill the throughput thereof and also the specific energy requirement to a greater extent than the capacity of the classifier to produce a steep grain build-up line in the finished product. The bypass component should be eliminated. A criterion indicating the extent to which this is successful is the proportion of finished or fine material present in the fluidized bed above the vane ring around the grinding pan. The aim is to reduce to the greatest possible extent the fine material proportion in the ground material bed, because this necessarily leads to an efficiency rise and energy saving for the overall roller mill-classifier combination.

Apart from the two aforementioned negative aspects every effort is made to produce a uniform material supply and distribution in the classifying chamber. It is constantly found that the material supplied to the classifier rotor in rolling mills is in stream-like form and is non-uniformly distributed over the rotor height, so that there is a marked dependence on the carrier gas flow rate.

Thus, every effort is made to make the grinding material supplied to the classifier as homogeneous as possible and so that it is distributed at uniform speed over the entire rotor height of the classifier.

Based on the aforementioned disadvantages, the object of the invention is to more efficiently design a roller mill air classifier with respect to the overall energy requirement of the plant, so as to significantly reduce the gas flow rates.

SUMMARY OF THE INVENTION

In the case of a roller mill air classifier of the aforementioned type, this object is inventively achieved in that a central riser for the rising gas-ground material flow and tapered with respect to the mill casing is provided and which in the upper area of the classifier rotor can be deflected radially outwards into a downflow, that in the classifier chamber are provided louvres directed towards the classifier rotor, that the gas-fine material flow passing from the outside to the inside through the classifier rotor is led off downwards through a bottom opening of the classifier rotor surrounding the central riser into a drop shaft around said riser and that the coarse material is returned from the classifier chamber downwards to the mill casing via return lines which are separate from the riser.

An essential feature of the inventive air classifier is constituted by the centrally located riser for the rising gas-ground material flow and coarse and fine materials can be led out of the classifier chamber in separate form into outer return lines or draw-off ducts. To this is added the energy-saving effect of a deflection of the carrier gas-ground material flow in the upper part of the classifier into a downflow, so that there is no need to expend the energy normally required for sucking off the fine material particles. In addition, the classifier chamber between the substantially vertical classifying ledges and the inner classifier casing wall is equipped with conical, ring-like louvre segments, which are provided in multistage form in the height of the classifier zone. These louvre segments are displaced, e.g. are fitted directly to the inner wall of the classifier casing or to the inner wall via spacers. The general orientation downwards and inwards of said louvre rings ensures that the gas-ground material flow dropping downwards on an upper louvre stage between the louvre and the inner wall of the classifier casing is again supplied inwards to the underlying classifier stage and therefore again to the classifying process, so that excellent classification takes place of fine material particles. Through the classifier ledges the fine material particles are fed into the classifying basket and via the classifier bottom opening surrounding in circular manner the riser are led downwards. In the lower part of the classifier can be provided a substantially horizontal gas draw-off duct, which appropriately has fine material collecting channels, which relieves downstream filters.

The coarse material hurled outwards in the classifier chamber by the centrifugal forces is collected in roughly funnel-like manner and led downwards. This takes place by means of external return lines, which are provided roughly arcuately in the lower part of the classifier and appropriately return the coarse material to the mill via bucket wheel sluices.

The concept of the inventive roller mill air classifier is characterized by a clear separation of the gas and material flows, there being a multiple supply to the classifying process with a more energy-saving design than with a downflow classifier.

The carrier gas-ground material flow led upwards in the central riser is channelled in mushroom-like manner in the upper area of the classifier casing by a downwardly directed distributing cone and the riser widening upwards to the rotor diameter and with a tapering flow duct. It is particularly advantageous if the deflection area of said channel has radially directed blades roughly on the distribution cone, which bring about a radial and tangential outflow.

The actual classifying ledges of the centrifuge basket or the rotor are disconnected round the height of the outflow channel via aerodynamically shaped driving pins. Only a few such driving pins are required, whilst the classifying ledges arranged below the same over a ring disk are designed in accordance with the classifying requirements, whilst taking account of the material to be processed and the rotary and gas velocities.

With regards to the necessary flow rates, e.g. in the case of the inventive air classifier a velocity of approximately 12 m/s is sufficient for raw cement material. The cylindrical outlet cross-section in the vicinity of the driving pins, i.e. between the rotor cover disk and the upper ring disk for the classifying ledges can be designed in such a way that a relatively low flow rate is possible there. For example in the vicinity of the classifier chamber velocities of 6 to 3 m/s can be set. As the fine material is led off downwards, the flow in the horizontal waste gas duct can also be very low, e.g. around 5 m/s. This significantly reduces wear on the material and also pressure losses.

The louvres provided in the classifier chamber can be closed rings, but are preferably ring segments, the louvre stages being radially reciprocally displaced. Appropriately below the arcuate areas of the higher louvre stage left free, once again ring segments are inwardly fitted for the supply of the grinding material.

For grinding materials with a high proportion of fines or fine added components, the upper part of the classifier can have an external material supply and appropriately the rotor cover disk serves as a whizzer.

The invention is described in greater detail hereinafter relative to a non-limitative embodiment and the attached drawings, wherein show:

DESCRIPTION OF THE EMBODIMENT

Figure 1:
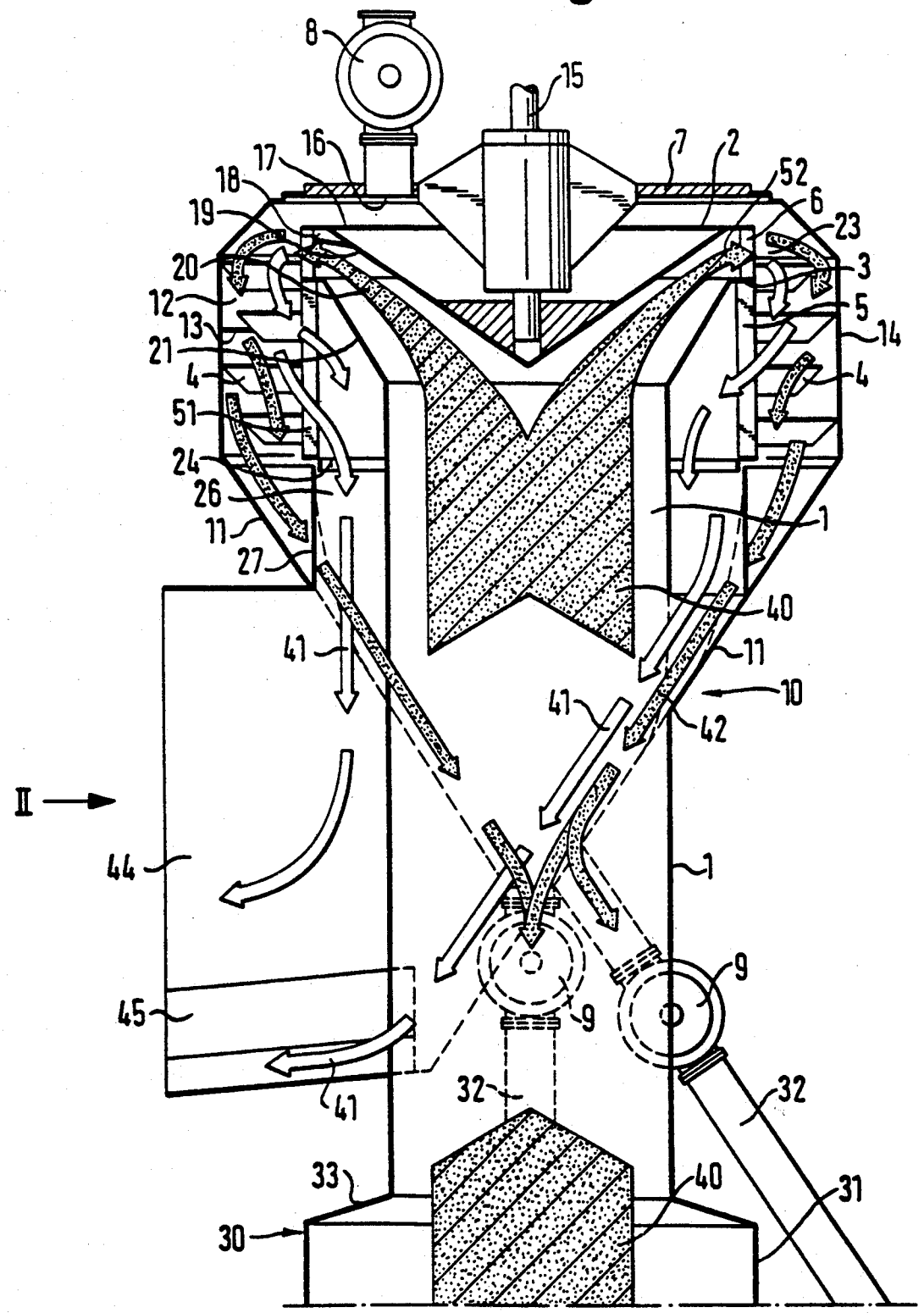
FIG. 1 An axial section through a classifier casing, the carrier gas and material flows being indicated by arrows and the mill casing is only diagrammatically indicated in the lower area.

The air classifier 10 shown in axial section in FIG. 1 is placed above the mill casing 31 of e.g. a roller mill 30. The carrier gas-grinding material flow 40 takes place vertically upwards into the classifier head in a central riser 1, which passes via a tapering portion 33 from the mill casing 31. The classifier casing 14 contains a smaller diameter classifier rotor 5 with substantially vertical classifying ledges 51. The classifier rotor 5 is driven by means of the rotor shaft 15 mounted in the upper part 7 of the classifier. At a relatively small distance below the upper part 7 of the classifier is provided the closed rotor cover disk 2, which functions as a whizzer 17 in the case of an external, upper material inlet 16. Upstream of the material inlet 16 can be provided a bucket wheel sluice 8. A downwardly directed distributing cone 19 is disconnected from the underside of the rotor cover disk 2. From the flow standpoint this distributing cone cooperates with the riser extension 21, which commences at roughly half the height of the centrifuge basket.

Several aerodynamically constructed driving pins 6, which can e.g. have a circular cross-section are connected in non-rotary manner to the rotor cover disk 2. At the lower end of the said driving pins 6 is fitted a ring disk 3, to which are fixed the vertically downwardly projecting classifying ledges 51.

The classifier rotor 5 has a larger diameter than the riser 1, the bottom region of the rotor 5 being open, so that a circular opening 24 is provided for fines passing out in the downwards direction.

In the vicinity of the cylindrical outlet cross-section of the rising carrier gas-ground material flow 40 are appropriately provided roughly radially oriented blades 18, which are fixed to the underside of the rotor cover disk 2 in order to improve the material distribution and to bring the channelled, rising flow 20 into a rotary movement.

From the flow standpoint in the outlet area 23 or in the deflection area of the rising gas-material flow can be set a relatively low speed, e.g. approximately 5.5 m/s.

The radially and tangentially deflected carrier gas-grinding material flow passes over into a downflow in the classifier chamber 12, which is formed between the inner of the classifier casing 14 and the classifying ledges 51. In order to achieve a homogeneous supply across the height of the classifier, on the wall side in the classifier chamber 12 are fitted several stages of louvre segments 4 with an inward and downward slope. These louvre segments 4 fixed in circular or ring segment manner to the inner wall of the classifier casing 14 are fixed in a preceding stage directly to the inner wall and in a following stage in displaced manner via spacers 13 to the inner wall.

Thus, the grinding material entering the classifier chamber 12 can be supplied several times to the classifying process. Coarse material or tailings, e.g. on the inner wall can be passed through the radial gap to the next stage of the louvre segments and are there again supplied to the classifying process in the vicinity of the classifying ledges 51. Thus, the louvre segments 4 bring about a uniform distribution of the gas flow over the entire rotor height, so that an efficient classification is brought about due to homogenization and multiple feeding. In particular the slope of the conical louvre segments 4 requires a precise matching with the other classifying components, such as gas flow, rotational speed, etc., in order to prevent attachment to the said louvre segments.

The coarse material 42 flows out of the classifier chamber 12 downwards into the conical collecting hopper, where the coarse material is supplied via arcuately guided return lines 32 with interposed bucket wheel sluices 9 to the mill casing 31 and the grinding dish. Part of the coarse material can also be led off directly from the collecting hopper 11. The fine material 41 passing through the classifying ledges 51 passes downwards via a drop shaft 26 connected to the bottom opening 24 of the classifying basket 3. The outer casing 27 of the drop shaft 26, which surrounds with a radial clearance the central riser in this case passes above the mill casing 31 into a horizontal spent air duct 44.

Figure 2:
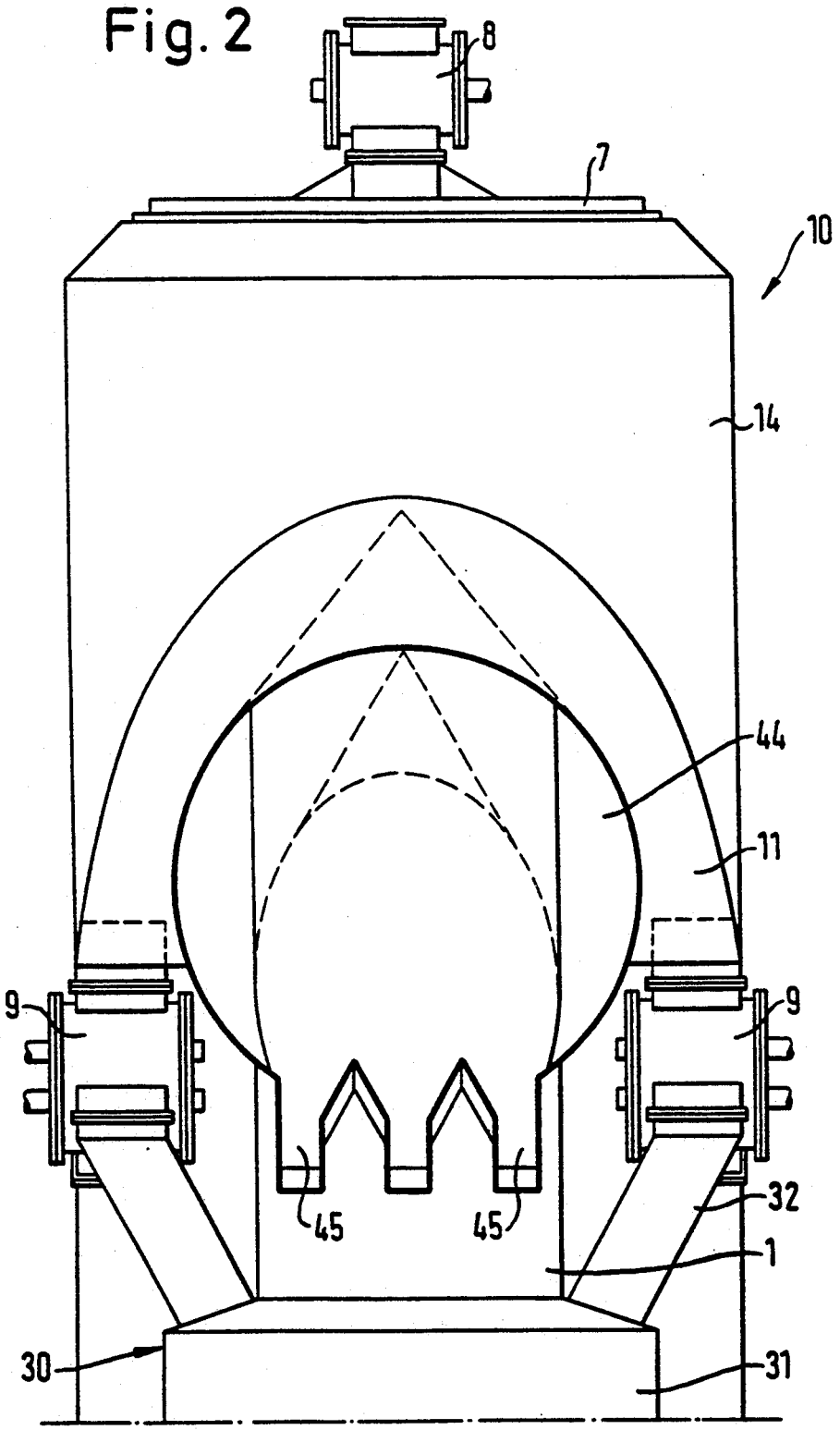
FIG. 2 A view of the classifier casing of FIG. 1 from the left in the direction of arrow II.

As is clearly shown in FIG. 2, said spent air duct 44 has in its lower region fine material collecting channels 45, in which part of the fines 41 can collect due to the relatively low waste gas flow rate of approximately 5 m/s. This relieves downstream filters and also significantly reduces the energy of the complete gas flow.

The inventive concept of the air classifier 10 in the case of integrated construction with a roller mill located below it improves the specific energy requirement per material quantity passed through and as a result of the low flow rates it is also possible to reduce material wear.

I claim:

1. A dynamic roller mill air classifier with an integrated air classifier for a rising gas-grinding material flow located above a roller mill, with a classifier rotor having roughly vertical classifying ledges, said classifier from the flow standpoint is followed by at least one gas flow outlet and a fine material outlet, as well as at least one coarse material return, with a mill casing for the roller mill, a classifier casing and a classifier chamber surrounding the classifier rotor, wherein a central riser for the rising gas-grinding material flow and which is tapered with respect to the mill casing is provided, deflection means is provided on the top of the riser for deflecting the rising gas-grinding material flow and which is deflected radially outwards into a gravity downflow in the upper area of the classifier rotor, louvres are provided in the classifier chamber which are directed towards the classifier rotor, for uniformly distributing the gas flow over the entire rotor height and for homogenous and repeated feeding of material to be classified to the rotor, a dropshaft around the riser into which the gas-fine material flow passing through the classifier rotor from the outside to the inside is led off downwards through a bottom opening of the classifier rotor surrounding the central riser and return lines are provided separately with respect to the riser for returning the coarse material from the classifier chamber downwards to the mill casing

2. A roller mill air classifier according to claim 1, wherein the deflection means comprises an extension portion at the top of the central riser cooperating with a downwardly directed distributing cone at the top of the rotor for the outwardly directed channelling of the rising gas-grinding material flow.

3. A roller mill air classifier according to claim 1, wherein the louvres provided in the classifier chamber are constructed as downwardly and inwardly sloping multistage ring segments, which are spaced radially from the classifier casing with alternating stages.

4. A roller mill air classifier according to claim 1, wherein the drop shaft passes into an approximately horizontal spent air duct with pre-separating chambers in the lower region for fine material.

5. A roller mill air classifier according to claim 1, wherein a cover disk is provided for the classifier rotor and is constructed as a whizzer.

6. A roller mill air classifier according to claim 1, wherein the upper part of the classifier casing has an external material inlet.

7. A roller mill air classifier according to claim 5, wherein the vertical classifying ledges are provided in spaced manner around the height of a deflecting channel below the cover disk.

8. A roller mill air classifier according to claim 7, wherein the classifying ledges are connected to the cover disk via a ring disk and aerodynamically shaped driving pins located in the deflecting channel.

9. A roller mill air classifier according to claim 1, wherein said louvres comprise multi-stages of ring segments attached to an outer wall of the classifier casing including a preceding stage ring segment directly to said wall and a succeeding stage ring segment attached to said wall by a spacer.

* * * * *